United States Patent [19]

Glans et al.

[11] Patent Number: 4,606,784

[45] Date of Patent: Aug. 19, 1986

[54] METHOD AND AN ARRANGEMENT FOR THE FOLDING AND SEALING OF THE LONGITUDINAL EDGE OF A MATERIAL WEB

[75] Inventors: Jan-Erik Glans, Kävlinge; Henry Corneliusson, Lund, both of Sweden

[73] Assignee: Tetra Pak International AB, Lund, Sweden

[21] Appl. No.: 438,648

[22] Filed: Nov. 3, 1982

[30] Foreign Application Priority Data

Nov. 5, 1981 [SE] Sweden ..... 8106548

[51] Int. Cl.[4] ..... B65B 7/20

[52] U.S. Cl. ..... 156/200; 156/227; 156/443; 156/461; 156/497; 156/499; 156/547; 493/243; 493/331; 493/442

[58] Field of Search ..... 156/497, 499, 200–202, 156/46, 463–465, 443, 425, 547, 551; 493/331, 178, 243, 231, 264, 397–399, 442–445; 72/178, 181; 53/373, 375, 379

[56] References Cited

U.S. PATENT DOCUMENTS

| | | | |
|---|---|---|---|
| 2,001,399 | 5/1935 | Scharwath | 493/442 X |
| 2,015,445 | 9/1935 | Bierer et al. . | |
| 2,783,693 | 3/1957 | Felber | 493/178 X |
| 3,130,649 | 4/1964 | Striplin et al. . | |
| 3,340,849 | 9/1967 | Adams et al. . | |
| 3,398,661 | 8/1968 | Mathes et al. . | |
| 3,527,631 | 9/1970 | Ryburn . | |
| 3,562,920 | 2/1971 | Vuilleumier | 156/497 X |
| 3,579,396 | 5/1971 | Washburn | 156/216 X |
| 3,602,029 | 8/1971 | Burke, Jr. | 72/220 |
| 3,711,352 | 1/1973 | Wagers et al. | 156/216 X |
| 3,791,185 | 2/1974 | Knudson | 72/181 |
| 3,978,191 | 8/1976 | Allen et al. | 493/442 X |
| 4,097,632 | 1/1978 | Minogue | 428/121 X |
| 4,251,312 | 2/1981 | Ziegler et al. | 156/465 |

FOREIGN PATENT DOCUMENTS

| | | |
|---|---|---|
| 73397 | 1/1893 | Fed. Rep. of Germany . |
| 101872 | 3/1898 | Fed. Rep. of Germany . |
| 290309 | 4/1953 | Fed. Rep. of Germany . |
| 1237524 | 3/1967 | Fed. Rep. of Germany . |
| 2255242 | 12/1974 | France . |
| 193594 | 12/1964 | Sweden . |
| 564996 | 8/1977 | U.S.S.R. . |
| 651872 | 3/1979 | U.S.S.R. . |
| 667456 | 6/1979 | U.S.S.R. . |

OTHER PUBLICATIONS

USSR article, "Can Sealing Machines", (1939), with translation.

*Primary Examiner*—David Simmons
*Attorney, Agent, or Firm*—Burns, Doane, Swecker & Mathis

[57] ABSTRACT

In the manufacture of packing containers from laminated material contact between the inner layer of the material and the contents is avoided by doubling up the cut edges present in the packing container. It has proved to be difficult to perform a secure folding and sealing of the folded edge without damage to the material, since the outer, water-tight layer of the material consists of very thin, heat-sensitive thermoplastic. This difficulty is overcome by carrying out the folding and sealing of the edge of the material web gradually while at the same time supplying heat or glue. By supplying the sealing-promoting agent as late as possible during the course of folding, damage to the material as well as to the folding arrangement is avoided.

15 Claims, 6 Drawing Figures

METHOD AND AN ARRANGEMENT FOR THE FOLDING AND SEALING OF THE LONGITUDINAL EDGE OF A MATERIAL WEB

BACKGROUND AND SUMMARY OF THE PRESENT INVENTION

The present invention relates generally to a process and apparatus for manufacturing packing containers. More specifically, the present invention relates to a method for the folding and sealing of the longitudinal edge of a material web and an arrangement for carrying out the method.

Packing containers of the non-returnable type for the packaging of e.g. milk and other liquid dairy products are manufactured from laminated packing material which includes a carrier layer of relatively stiff material, e.g. paper, which, at least on the side which is intended to be in contact with the contents, is covered with a liquid-tight, preferably thermoplastic material, e.g. polyethylene. Beside serving as a material conferring imperviousness, the thermoplastic layer is also used for making possible the heat-sealing of the laminate. For this reason, it is often advantageous if the opposite side, that is to say the outer side, of the carrier layer is also covered with a thermoplastic material. When the packing laminate is to be converted into packing containers these are formed in a known manner by folding and sealing of the laminate, so that packing containers of the desired shape are obtained. It is of the greatest importance that the seals, which unavoidably must be present on the finished packing container, should be completely impervious to liquid. This is particulary difficult to achieve if seals of the "inside-to-outside" type are used, since the lower packing laminate edge, that is to say the edge facing towards the inside of the packing container, will then come into contact with the contents, not only with the thermoplastic-covered surface, but also with the cut edge itself where the carrier layer is exposed. In the case of a carrier layer of the fibrous type, this will gradually absorb contents, which detrimentally affects the tightness and the durability of the package. To prevent this it is known to double up the internal edge zone of the material so that the inner thermoplastic layer extends around the inner edge of the packing laminate and is sealed against the inside of the outer packing laminate. In this way contact between the contents and the carrier layer is effectively prevented so that the problem of absorption of the contents into the packing material is eliminated.

The folding of the edge zone of the material web gives rise to a doubling of the thickness of the material which in the case of most types of packing containers brings about an unacceptable increase of the thickness of the seal. For this reason a thinning of the edge zones, which later are to be doubled up, is therefore frequently performed in connection with the manufacture of the packing laminate, so that in these zones the material thickness is reduced to approximately one half to one third of the original value. The actual folding of the thinned edge zone, however, takes place only later and is carried out appropriately just before the material is converted to packing containers by passing the material through a folding arrangement. It has been found to be an advantage, if the sealing of the folded edge zone to the main part of the material web is performed jointly with the folding, since it can be assured in this way that the folding remains unaltered during the conversion of the material web to packing containers and at the same time the strength and tightness of the final seal are increased.

The folding and sealing work is made more difficult by the circumstance that only a very narrow edge zone (approx. 3 mm) is to be folded over, which owing to the small thickness of the material easily leads to the folding going wrong, so that the material is damaged. Moreover, it is difficult to achieve a durable seal of the folded-down edge zone. When the sealing of the same is done by making use of the thermoplastic layer present as an adhesive it has been found, for exemple, that the heat, which has to be applied in order to soften the thermoplastic layer, easily damages the material, so that the plastic layer is thinned out and becomes leaky in connection with the subsequent folding. Not only when the heated thermoplastic layer is used as an adhesive, but, also when an external adhesive (e.g. so-called hot-melt) is used, deposits of adhesive are formed in time on the folding tools which gradually diminish their function and jeopardize operational safety.

It is an object of the present invention to provide a method for folding and sealing a longitudinal edge of the material web, which method is not subject to the abovementioned disadvantages but can be performed at high speed and with good safety and accuracy.

This and other objects have been achieved in accordance with the invention in that a method of the type described in the beginning has been given the characteristic that the material web is fed continuously with gradual folding of an edge zone at the same time as a sealing-promoting agent is supplied to the folding area.

It is a further object of the present invention to provide an arrangement for the carrying out of the method, which arrangement is of a simple and reliable design.

This object has been achieved in accordance with the invention in that an arrangement for the folding and sealing of the longitudinal edge of a material web has been given the characteristic that it includes a number of co-operating rollers, between which the edge of the material web is arranged to pass, these rollers being profiled and provided with forming components in the shape of truncated cones whose point angles vary so that the edge zone of the material web, fed between the rollers, is gradually folded about 180°.

Preferred embodiments of the method as well as of the arrangement in accordance with the invention have been given the characteristics evident from the description.

The method and the arrangement in accordance with the invention make it possible to provide a secure and accurate folding. The gradual, accurately controlled folding with the help of the co-operating profiled rollers of the arrangement, practically excludes any possibility of faulty folding. The activation or the supply of adhesive only after approximately half the folding process has been carried out, effectively prevents the first components of the folding arrangement, seen in the direction of movement of the web, from being dirtied with adhesive. At the same time, the fact that the adhesive is placed (or activated) in the correct position between the already partially folded parts of the web prevents any serious dirtying of the subsequent parts of the folding arrangement, so that these too remain clean and free from deposits of adhesive. The supply of heat during the later part of the folding process also means that the risk of the heat penetrating through the material and softening even the thermoplastic layer at the back of the material is much smaller, which in turn also prevents deposits on the folding arrangement, and contributes to the packing laminate presenting a completely impervious outer plastic layer, also after the folding and sealing of the longitudinal edge zone.

BRIEF DESCRIPTION OF THE DRAWINGS

A preferred embodiment of the method as well as of the arrangement in accordance with the invention will now be described in more detail with special reference to the attached schematic drawing, which only shows the particulars necessary for an understanding of the invention.

DETAILED DESCRIPTION OF THE PREFERRED EMBODIMENT

Figures 1, 2, 3, 4, 5, 6:
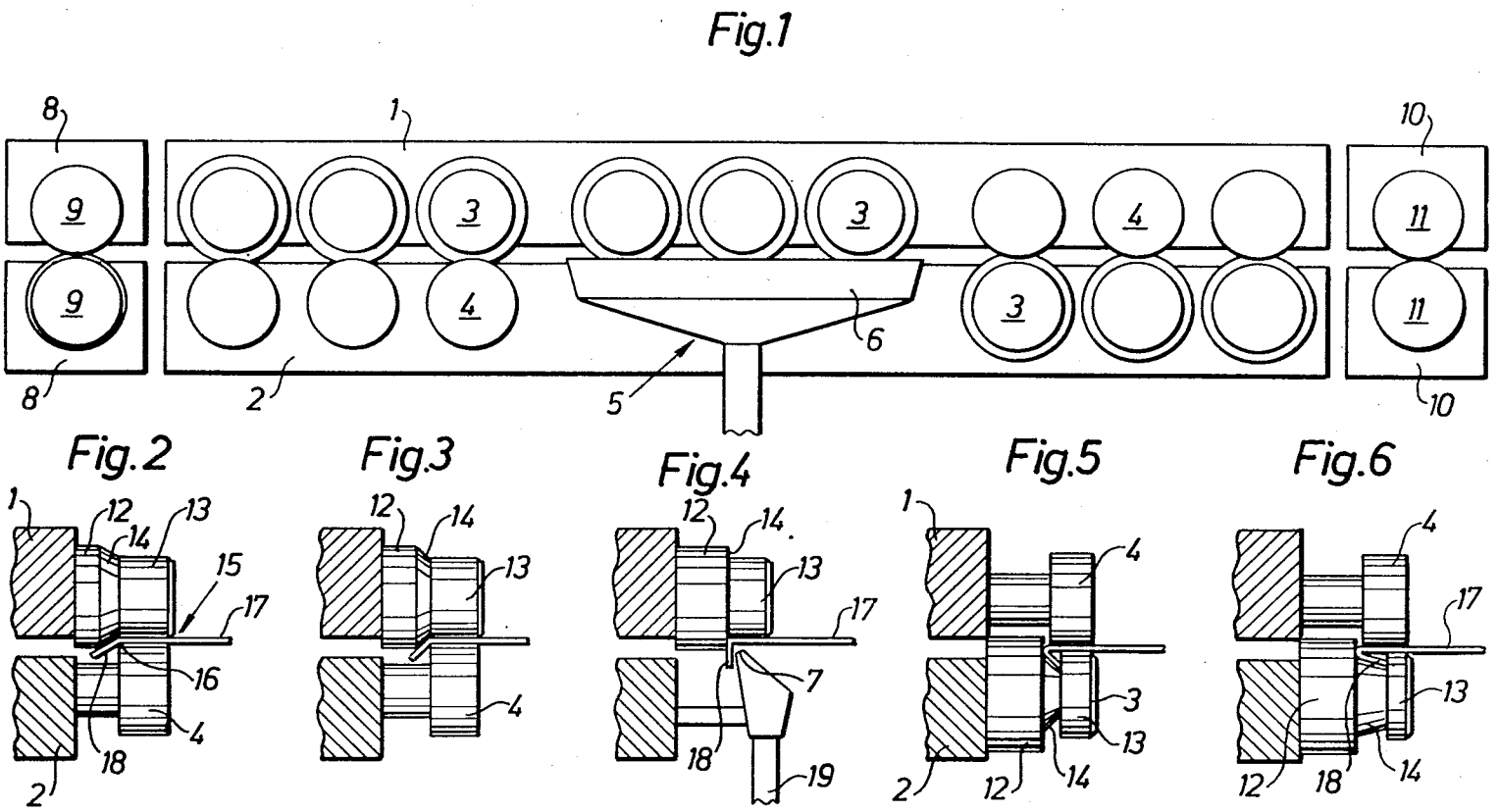
FIG. 1 is a side view of an arrangement for the folding and sealing of the longitudinal edge of a material web in accordance with the invention.
FIGS. 2–6 are sections through the arrangement in accordance with FIG. 1 and show the design of the co-operating rollers of the arrangement to make possible a gradual folding and sealing of the longitudinal edge zone of a material web.

The arrangement in accordance with the invention includes two carrier elements supported by a stand, not shown in the drawing, namely an upper carrier element 1 and a lower carrier element 2. The carrier elements are provided with a number of axles arranged in a straight line following each other (not shown) on which forming rollers 3 and counter-rollers 4 are mounted so that they freely rotate. The carrier element 1 thus includes a first row of rollers 3, 4 arranged in line with one another, and the carrier element 2 located underneath the carrier element 1 includes a second row of rollers 3, 4 arranged in line with one another. The rollers are divided, moreover into three groups, namely as can be seen from the drawing, a first group of three pairs of rollers (to the left in FIG. 1), a second group of three rollers arranged on the upper carrier element 1, and a third group (to the right in FIG. 1) of three pairs of rollers. The first and third group each includes forming rollers 3 as well as counter-rollers 4 which co-operate with each other and are mounted on opposite carrier elements 1, 2. The center group of rollers includes exclusively forming rollers 3 which are mounted on the upper carrier element 1. Underneath these there is a heating element 5 supported by the lower carrier element which includes a nozzle 6 with an outlet opening 7 directed towards the forming rollers 3 of the second group (FIG. 4).

The two carrier elements 1, 2 are arranged in the stand substantially parallel with one another and are adjustable so that they can be moved in the direction towards, or away from, each other. The distance between the rollers 3, 4 supported by the carrier elements 1, 2 can be regulated, likewise the distance between the outlet opening 7 of the heating element 5 and the forming rollers 3 opposite it.

To the left of the two carrier elements 1, 2 in FIG. 1, that is to say at the side of the carrier elements 1, 2 where a packing material web intended for processing is introduced into the arrangement in accordance with the invention, an upper and a lower auxiliary carrier element 8 are situated which, similarly to the two main carrier elements 1, 2 are adjustable in the direction towards, or away from, each other. Each of the auxiliary carrier elements 8 is fitted with a creasing roller 9 which is supported on an axle (not shown) so that it can freely rotate. The creasing rollers 9 are of conventional design and have a substantially cylindrical surface which on the one roller is provided with a ridge extending around the roller and on the other roller is provided with a groove, corresponding in location and size to the ridge, so as to make possible the creasing of a packing material web fed between the rollers.

At the opposite end of the carrier elements 1, 2 (that is to say the end at which a packing material web processed by the rollers 3, 4 is intended to be discharged), further upper and lower auxiliary carrier elements 10 are situated which support two pressure rollers 11 co-operating with one another and arranged so that they are freely rotatable. The pressure rollers 11 are cylindrical and movable in a direction towards, or away from, each other with the help of the auxiliary carrier elements 10. At least one of the pressure rollers, preferably the lower one, is provided with a cylindrical working surface of an elastic material, e.g. hard rubber. The pressure rollers 11 normally rest against each other so that there is no space between them, and a passing material web thus has to displace part of the elastic material in order to pass between the rollers, as a result of which the material web is subjected to a powerful pressure. It may be possible that no separate adjusting facility for the distance between the creasing and pressure rollers respectively is required, and in this case these rollers can be mounted directly on the main carrier elements 1, 2, which means that the auxiliary elements 8, 10 may be omitted.

As mentioned earlier, the two carrier elements 1,2 comprise two different main types of rollers, namely on the one hand forming rollers 3 and on the other hand counter-rollers 4. All the forming rollers 3 comprise an inner and an outer cylindrical part 12, 13 (FIGS. 2–6) the inner part 12 having a greater diameter than the outer part 13. Between the two cylindrical parts 12, 13 there is a forming part 14 whose surface connects the surfaces of the two cylindrical parts 12, 13 to one another. The different parts of the rollers are preferably moulded in one piece, but it is also conceivable to mould the different parts each by itself, if this appears advantageous e.g. for economic reasons. The forming part 14 is conical in the majority of forming rollers 3, and within the first group of rollers (the three pairs of rollers located to the left in FIG. 1) the conicity varies from roller to roller so that the first forming roller 3 has a point angle of approx. 30°, the second forming roller 3 has a point angle of approx. 45° and the third forming roller has a point angle of approx. 60°. This is clearly evident from FIGS. 2 and 3 which among other things show the first and the last forming roller 3 in the first group of rollers.

The counter-rollers 4 co-operating with the forming rollers 3 are all cylindrical and are placed so that they co-operate with the outer cylindrical parts 13 of the forming rollers. The counter-rollers 4 too are supported in the carrier elements 1, 2 so that they are freely rotatable. These carrier elements 1, 2 which during operation are normally at such a distance from each other that between the cylindrical surface of the counter-rollers 4 and the outer cylindrical part 13 of the forming rollers an interspace is present. This substantially corresponds to the thickness of the material which is to be processed.

As can be seen from the drawing, in the first group of rollers the forming rollers 3 are arranged on the upper carrier element 1 while the counter-rollers 4 are supported by the lower carrier element 2.

The second group of rollers (the three center rollers supported by the carrier element) consist exclusively of forming rollers 3 which are all identical and, beside the inner cylindrical part 12 and the outer cylindrical part 13 include a forming part 14 whose surface extends at an angle of 90° to the plane of the material web (FIG. 4). The forming rollers 3 in the second group of rollers do not co-operate with any counter-rollers and may be given, therefore, a freer design and positioning than the other rollers. Thus, it is also possible to orientate these rollers so that their centre axes form an angle of 90° with the main plane of the material web, the rollers being given a simple cylindrical design, possibly completed by guiding boundary surfaces in the form of flanges or other guide surfaces. The lower carrier element 2 supports the heating element 5 which is arranged at the same level as the forming rollers 3 of the second group and which is connected via a hose 19 to a source of hot air (not shown). The outlet opening 7 of the nozzle 6 is long and narrow and extends in the longitudinal direction of the arrangement, that is to say parallel with a packing material web fed through the arrangement in accordance with the invention. The outlet opening 7, moreover, is directed towards the angle between the outer cylindrical part 13 and the forming part 14 of the forming rollers 3. The distance between the forming rollers 3 and the outlet opening 7 is regulated, similarly to the distance between the upper and the lower row of rollers, by the two carrier elements 1, 2 being moved in the direction towards, or away from, each other.

The third group of rollers, like the first group, comprises three pairs of rollers arranged in series behind one another. However, contrary to what is the case in the first group, the forming rollers 3 here are supported by the lower carrier element 2 while the upper carrier element 1 supports the counter-rollers 4 co-operating with the forming rollers. The forming rollers 3 present within this group, similarly to the forming rollers described earlier, have an inner cylindrical part 12 and an outer cylindrical part 13 whose diameter is somewhat smaller than the diameter of the inner cylindrical part 12 (FIGS. 5 and 6). Between the two cylindrical parts 12, 13 there is the conical forming part 14 whose conical surface, however, does not connect the cylindrical surfaces of the two parts 12, 13 as in the forming rollers described previously. Instead the conical surface of the forming part 14 is situated in a groove in the forming roller 3, as is evident from FIGS. 5, 6 which show the first and the last pair of rollers respectively in the third group of rollers. As in the first group of rollers the conical forming parts are positioned here in such a manner that the large end of the truncated cones is located closest to the carrier elements 1, 2. Moreover, the largest diameter of the cones is substantially equal to the diameter of the outer cylindrical part 13. The point angles of the conical forming parts 14 vary within this group too between the different pairs of rollers. More particularly, the point angle diminishes successively, seen in the direction of movement of the material web, that is to say from left to right in FIG. 1. Thus the forming rollers 3 in the first pair of rollers have a conical forming part 14 with a point angle of approx. 60° (FIG. 5), while the second forming roller 3 has a point angle of approx. 45° and the third forming roller (FIG. 6) has a point angle of approx. 30°.

The counter-rollers 4, co-operating with the forming rollers 3 of the third group, are designed similarly to the preferred types of counter-rollers described earlier and thus comprise a cylindrical working surface which co-operates with the outer cylindrical part 13 of the forming rollers 3. The cylindrical working surface of the counter-rollers 4, moreover, is of such a width that it covers not only the outer cylindrical part 13 of the forming rollers 3 but also the recessed, conical forming part 14. The periphery of the counter-rollers facing towards the carrier elements 1, 2, in other words, is always straight in front of the end of the truncated conical forming parts 14 whose diameter corresponds to the diameter of the outer cylindrical part 13, as is clearly evident from FIGS. 2–6.

The shape of the rollers 3, 4 as well as their number and placing may vary within certain limits in order to achieve a result which for different types of material fulfills the requirements regarding accuracy and economy. Thus, for example, the number of rollers may be varied, where it has been found, for example, that the part of the folding process which takes place after the heating of the adhesive is more difficult to perform with certain types of material and therefore has to be carried out more gently than the earlier part of the folding. This means that a modified form of the arrangement in accordance with the invention has fewer pairs of rollers in the first group of rollers and more in the last. Naturally the point angles of the forming rollers 3 also have to be adapted in a suitable manner to the requirements of the material.

The method and the arrangement in accordance with the invention are intended to be used for the folding and sealing of the longitudinal edge on a material web of the type which generally comprises a central carrier layer of paper which is covered on either side with thin layers of thermoplastic material. Packing laminate of this main type may also include layers of other material, e.g. aluminium foil, which however does not alter either the method or the arrangement in accordance with the invention. The preferred embodiment shown of the arrangement and the method of operation, which will be described in the following, are based on the assumption, however, that the packing laminate includes at least one external thermoplastic layer which can be used for the sealing of the folded, longitudinal edge. If the packing material is of the type which lacks a layer suitable for sealing, a glue has to be applied and used for the sealing. The arrangement in accordance with the invention will then be provided with a device for the application of some suitable glue, e.g. so-called hot-melt, instead of the heating element 5 described earlier in the same place.

The embodiment shown and described is thus intended to be used in the processing of a material web provided with an outer plastic layer (polyethylene), one longitudinal edge of which is to be folded about 180° and sealed to the non-folded main part of the material web. To facilitate the folding the material web is appropriately provided, in a known manner, with a longitudinal crease line which divides the material web into the main part and an edge zone and helps to guide the folding so that the folded edge zone obtains a uniform predetermined width of e.g. 3 mm. Although the creasing can be carried out in advance in connection with the manufacture of the thermoplastic material, it is generally to be preferred for the creasing to be performed in conjunction with the folding over. The arrangement shown, as mentioned earlier, is provided for this reason with creasing rollers 9 at the end of the arrangement where the material web is to be introduced. With the help of steering elements (not shown) in the form guiding rails, rollers or the like, the web is introduced between the creasing rollers 9 in such a manner that the web edge which is to be folded over is facing towards the carrier element 8. During the processing the material web is moved from left to right in FIG. 1 and is advanced appropriately by the packing machine on which the arrangement in accordance with the invention is mounted. One or more of the pairs of rollers of the folding arrangement may possibly also be driven, but normally this should not be necessary.

After the material web has passed the two creasing rollers 9, and has been provided by these with a longitudinal crease line, it is fed in between the rollers in the first pair of rollers on the carrier elements 1, 2. The two carrier elements 1, 2 are placed so in relation to each other that the distance between the outer cylindrical parts 13 of the forming rollers and the counter-rollers 4 is substantially of the same size as the thickness of the packing material processed. As can be seen from FIG. 2, the material web 15 provided with crease line is guided in between the forming roller 3 and the counter-roller 4 in such a manner that its longitudinal crease line 16 is right in front of the periphery of the counter roller facing the carrier element 2. The main part 17 of the material web 15 will be located at this time between the outer cylindrical part 13 of the forming roller 3 and the counter-roller 4 while the edge zone 18 of the material web 15 is bent downwards by the forming part 14 towards the free space between the counter-roller 4 and the carrier element 2.

Owing to the successive increase of the point angle on the truncated conical forming parts 14 on the forming rollers 3 arranged in the first group of rollers, the edge zone 18 of the material web will be gradually folded until it is positioned substantially right-angled to the main part 17 of the material web 15, which occurs when the material web reaches the first roller in the second group, that is to say the fourth roller in the carrier element 1, seen in the direction of movement of the material web. In this position the main part 17 of the material web rests against the outer cylindrical part 13 of the forming roller 3 at the same time as the crease line 16 is in the angle between the said cylindrical part and the forming part 14. With the help of the hot air nozzle 6 described earlier, hot air (approx. 250°) is now conducted via the outlet opening 7 to the space in the angle between the main part 17 of the material web 15 and the edge zone 18, so that the thermoplastic present there is heated to its melting temperature (approx. 130° C.). Owing to the positioning and the direction of the outlet opening of the nozzle, and the short distance between the outlet opening and the two web parts at a right angle to one another, the heating of the thermoplastic layer is confined to a relatively narrow area in the angle between the two parts of the material web. This prevents the surrounding parts of the thermoplastic layer from being damaged. While heating is continued, the material web is moved past the three forming rollers 3 present in the second group of rollers and retains the whole time a substantially right angle between the main part 17 and the edge zone 18 of the web.

After the heating of the thermoplastic layer of the material web has been completed, the material web reaches the first pair of rollers of the last or third roller group which is shown in FIG. 5. The folding of the edge zone 18 of the material web is resumed as soon as the edge zone reaches the forming part 14 shaped as a truncated cone of the forming roller 3, which forces the edge zone 18 to be folded further at the same time as it is bent down into the groove in the forming roller 3 where the truncated conical forming surface is situated. As mentioned earlier, the forming rollers 3, which make up the third roller group, have truncated conical forming parts 14 with a stepwise diminishing point angle, with the result that the longitudinal edge zone 18 of the material web is folded more and more until, on passing the last pair of rollers, it is substantially doubled up (FIG. 6). The speed of the material web and the heating of the material web have been adapted in such a manner that the thermoplastic layer, which is to be used for the sealing of the folded edge zone, continues to be at such a temperature that it is soft and can be used for sealing. After the material web has left the last pair of rollers which is supported by the carrier elements 1, 2, it reaches the two cylindrical pressure rollers 11. With the help of these now the final doubling up and pressing together of the main part 17 and the edge zone 18 of the material web is achieved in such a way that the edge zone 18, with the help of the heated thermoplastic layer serving as an adhesive, is joined to the area of the main part 17 of the material web located underneath it. The distance between the two pressure rollers 11 is adjusted so that the web parts are pressed to each other with sufficient force to ensure that a reliable and durable seal is formed. The material web thus has been provided with the desired, doubled up and liquid-tight edge and is advanced further to be converted subsequently in a known manner to a liquid-tight material tube, which after filling with the desired contents, is converted to filled packing containers by repeated, transverse sealing operations.

Because according to the method in accordance with the invention the activation or application of the adhesive is performed only after a large part of the folding work has been carried out, a number of advantages are achieved in the form of safer operation, higher working speed and less damage to the material. It is obvious, for example, that the risk of dirtying of the tool by applied or activated glue is reduced by the fact that the application of adhesive or activation take place only in a later stage of the folding. In the case of folding of the type of packing laminate which includes thermoplastic layers on either side of the carrier layer, moreover, the risk of damage to the opposite thermoplastic layer, that is to say that situated on the outside of the folding, is reduced, since the late application of heat prevents the heat from penetrating through the carrier layer and softening up this opposite thermoplastic layer too. This previously constituted a problem causing the thermoplastic layer to be damaged and parts of the layer to stick to the rollers. By partly or wholly interrupting the folding process after the edge zone has been folded to an angle of approx. 90°, the sealing-promoting agent (glue or hot air) is concentrated to the area where its effect will be greatest, so that undesirable spreading to adjoining parts of the material or the arrangement is avoided. The method as well as the arrangement in accordance with the invention have proved to function well in practice, and have made it possible for the first time to produce packing containers with a folded and sealed web edge in a rational, commercially viable manner.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not as limiting to the scope and spirit of the invention as set forth in the appended claims.

What is claimed is:

1. A method of forming a folded edge in a packing web having an exterior layer of thermoplastic material, so that an edge zone of the web is folded flat against a zone bordering said edge zone along a fold-line, comprising the steps of:

continuously feeding the material web;

progressively folding said edge zone by steps until said edge zone has been folded approximately 90° relative to said bordering zone with said thermoplastic layer disposed inside of the 90° fold;

supplying heat to the inside of the 90° fold along said edge zone and said bordering zone while maintaining said edge zone folded at approximately 90°;

further progressively folding said edge zone by steps until said edge zone has been folded approximately 180° relative to said bordering zone; and pressing said edge zone against said bordering zone so as to thermally seal the edge zone to the bordering zone.

2. The method of claim 1, further comprising the step of providing the material web prior to the 90° progressive folding step with a crease line to guide the folding.

3. The method of claim 1, wherein said progressively folding step comprises passing said edge zone between an initial series of pairs of cooperating rollers and said further progressively folding step comprises passing said edge between a final series of pairs of cooperating rollers, said supplying step occurring in space provided between said initial and final series.

4. An arrangement for manufacturing a packing web with an edge zone of the web folded flat against a zone bordering said edge zone along a fold-line, said web having an exterior layer of thermoplastic material, said arrangement comprising:

means for feeding said material web along a path;

prefolding means along a first length of said path for progressively folding said edge zone by steps until said edge zone is folded at approximately 90° relative to said bordering zone with said thermoplastic layer disposed inside of the 90° fold;

means for maintaining said edge zone folded at approximately 90° along a second path length subsequent to said first path length;

means along said second path length for supplying heat to the inside of the 90° fold along said prefolded edge zone and said bordering zone;

means along a third path length subsequent to said second path length for further progressively folding said edge zone by steps until said edge zone has been folded approximately 180° relative to said bordering zone; and means along a fourth path length subsequent to said third path length for pressing said edge zone against said bordering zone so as to thermally seal said edge zone to said bordering zone.

5. The arrangement of claim 4, wherein:

said prefolding means includes a plurality of first pairs of cooperating rollers between which said edge zone passes, each first pair of rollers including a forming roller and a counter-roller, said forming roller being indented and being provided with a truncated conical forming part for folding said edge zone;

said maintaining means includes at least one forming roller positioned adjacent said supplying means, said supplying means comprising a hot air nozzle, said edge zone passing between said at least one forming roller and said hot air nozzle; and said further folding means includes second pairs of cooperating rollers between which said edge zone passes, each second pair of rollers including a forming roller and a counter-roller, said forming roller being being indented and being provided with a truncated conical forming part for further folding said edge zone of said material web.

6. The arrangement of claim 5, further comprising:

creasing means preceding said first path length for creasing said material web to define said edge zone.

7. The arrangement of claim 6, wherein said creasing means includes a pair of cooperating rollers and said pressing means includes a pair of cooperating rollers.

8. The arrangement of claim 5, wherein cone angles of the forming rollers of said first pairs increase from pair to pair in the direction of movement of the web, the forming part of the second forming roller of the maintaining means being at an angle of approximately 90° with respect to the plane of the web and cone angles of the forming rollers of said second pairs decreasing from pair to pair in the direction of movement of the web.

9. The arrangement of claim 5, wherein each of the forming rollers of the first and second pairs include two cylindrical parts between which the forming part is located.

10. The arrangement of claim 5, wherein the rollers of said prefolding means, said maintaining means and said final folding means are arranged in two substantially parallel rows, the forming rollers of said prefolding means being arranged in the one row, the forming rollers of said further folding means being arranged in the second row.

11. The arrangement of claim 10, wherein the hot air nozzle has an elongated outlet opening which extends parallel with the direction of movement of the web and is directed toward an angled area between the main portion of the material web and the folded edge zone.

12. The arrangement of claim 10, wherein said first and second pairs of rollers are supported so that they are freely rotatable by two elongated, substantially parallel carrier elements which are movable so that the distance between the two row of rollers can be adjusted.

13. The arrangement of claim 12, further comprising a pair of cooperating creasing rollers which are arranged before the first pairs of rollers.

14. The arrangement of claim 13, wherein said pressing means comprises a pair of substantially cylindrical pressure rollers.

15. The arrangement of claim 14, wherein at least one of the pressure rollers has a working surface of an elastic material.

* * * * *